US008333097B1

(12) United States Patent
Frear

(10) Patent No.: US 8,333,097 B1
(45) Date of Patent: Dec. 18, 2012

(54) HYDRAULIC BENDER FOR A SKID-STEER LOADER

(76) Inventor: Robert Frear, North Redington Beach, FL (US)

( * ) Notice: Subject to any disclaimer, the term of this patent is extended or adjusted under 35 U.S.C. 154(b) by 315 days.

(21) Appl. No.: 12/718,582

(22) Filed: Mar. 5, 2010

Related U.S. Application Data

(63) Continuation-in-part of application No. 12/157,433, filed on Jun. 10, 2008.

(51) Int. Cl.
*B21D 7/02* (2006.01)
*B21D 7/022* (2006.01)

(52) U.S. Cl. ..... 72/217; 72/216; 72/387; 72/453.18

(58) Field of Classification Search ..... 72/449, 72/453.03, 149, 214–218, 31.04, 369, 128–132, 72/307, 387, 457, 705, 453.18
See application file for complete search history.

(56) References Cited

U.S. PATENT DOCUMENTS

| | | | | |
|---|---|---|---|---|
| 2,886,846 | A * | 5/1959 | Meyer | 452/142 |
| 3,680,347 | A | 8/1972 | Schenck et al. | |
| 3,891,187 | A | 6/1975 | Bearden, Jr. | |
| 4,561,279 | A | 12/1985 | Wears | |
| 4,773,284 | A * | 9/1988 | Archer et al. | 72/307 |
| 4,945,751 | A | 8/1990 | Ireland | |
| 5,129,246 | A | 7/1992 | Strickland et al. | |
| 5,144,829 | A | 9/1992 | Fabro et al. | |
| 5,203,192 | A | 4/1993 | Kimura | |
| 5,791,820 | A * | 8/1998 | Rempel | 405/232 |
| 5,878,615 | A | 3/1999 | Brown | |
| 5,931,039 | A | 8/1999 | Yoshimizu et al. | |
| 6,030,169 | A * | 2/2000 | Rossow et al. | 414/680 |
| 6,230,535 | B1 | 5/2001 | Benes et al. | |
| 6,418,773 | B1 | 7/2002 | Tolman | |
| 6,993,950 | B2 | 2/2006 | Bryan | |
| 8,201,430 | B1 * | 6/2012 | Frear | 72/217 |

* cited by examiner

*Primary Examiner* — Dana Ross
*Assistant Examiner* — Pradeep C Battula
(74) *Attorney, Agent, or Firm* — Larson & Larson, P.A.; Frank Liebenow; Justin Miller

(57) ABSTRACT

An application for a device that bends a workpiece includes a rotary hydraulic actuator. The rotary hydraulic actuator is fluidly coupled to a controlled source of hydraulic fluid pressure and has an rotating flange that turns responsive to the hydraulic fluid pressure. A bending member is coupled to the rotating flange of the rotary hydraulic actuator and rotates responsive to the rotational motion of the rotating flange. A bending mandrel is mounted on a face of the bending member at a center of rotation of the bending member and a force mandrel mounted on the face of the bending member. An actuator controls the hydraulic fluid pressure and clips are provided for attaching the device for bending to a boom of, for example, a skid-steer loader.

20 Claims, 9 Drawing Sheets

HYDRAULIC BENDER FOR A SKID-STEER LOADER

CROSS-REFERENCE TO RELATED APPLICATION

This application is a continuation of U.S. patent application Ser. No. 12/157,433, filed Jun. 10, 2008, the disclosure of which is hereby incorporated by reference.

FIELD

This invention generally relates to the bending and forming of metal rods and bars, especially concrete reinforcement bars (rebar).

BACKGROUND

Concrete reinforcement bar, hereafter referred to as rebar, has been used in construction for many years. Rebar is produced in straight pieces of varying lengths, sometimes up to 40 feet. Rebar needs to be bent before being placed for various reasons such as foundation corners, column "cages" and the like. Until recently, job site bending and cutting was done with a manual tool or machine such as the one invented by Tolman, U.S. Pat. No. 6,418,773 BI. Currently there are several attempts at providing a means to bend and cut rebar on the job site, these include table mounted electrically powered machines, trailer mounted hydraulic and electrically powered machines, small handheld machines, and one known loader mounted hydraulically powered machine invented by Brown, U.S. Pat. No. 5,878,615.

Because of the extreme weight and awkwardness of rebar and the normally rough job site terrain, table top machines are not stable enough to efficiently perform. Handheld machines are not designed for larger size rebar or production bending and cutting. Both table top and handheld machines require electrical power, a external hydraulic power source, or both. Trailer towed machines lack the ability to access areas that skid steer loaders do either for job site space constraints or terrain features.

Because of their great power, all-terrain ability and the versatility of quickly adding and changing a variety of attachments, skid-steer loaders have become common in the construction industry. Most skid-steer loaders are manufactured with hydraulic connections at the end of the lift arms enabling attachments that require hydraulic power to be used. This all-terrain hydraulic power source coupled with the stable work platform provided by the loaders heavy weight and low profile make my hydraulic rebar bender cutter attachment for skid-steer loader the preferred tool for jobsite metal bending and cutting.

Browns device though capable of being attached to a loader vehicle lacks the ability to bend beyond approximately 90 degrees. This is a major limitation since bends of up to 180 degrees are common in the industry. Additionally, although he claims his invention requires only one hydraulic cylinder to perform, it actually has two separate hydraulic cylinders with an accompanied sequencing valve, complicating the process. Therefore a need remains for a simple, reliable, loader mounted rebar bending and cutting attachment that is capable of production bends of up to 180 degrees without repositioning the rebar.

What is needed is a system that bends elongated objects and readily attaches to job site equipment such as a skid-steer loader.

SUMMARY

In one embodiment, a device for bending a workpiece is disclosed including a rotary hydraulic actuator. The rotary hydraulic actuator is fluidly coupled to a controlled source of hydraulic fluid pressure and has a rotating flange that turns responsive to the hydraulic fluid pressure. A bending member is coupled to the rotating flange of the rotary hydraulic actuator and rotates responsive to the rotational motion of the rotating flange. A bending mandrel is mounted on a front face of the bending member and a force mandrel mounted on the face of the bending member. A device is provided for actuating the hydraulic fluid pressure and a device is provided for attaching the device for bending to a boom of, for example, a skid-steer loader.

In another embodiment, a device for bending a workpiece is disclosed including a case and a device for converting hydraulic pressure into a rotational force of a bending member. The rotational force is controlled by an actuator and the device for converting hydraulic pressure into a rotational force is mounted within the case and attached to a rear surface. A bending mandrel is mounted on a shaft, the shaft passing through the bending member at center of rotation of the bending member and passing through the device for converting hydraulic pressure into the rotational force. The shaft is affixed to a back surface of the case, preventing it from rotating. A force mandrel is mounted on the face of the bending member and a bracket for attaching the device for bending the workpiece to a boom of, for example, a skid-steer loader is on the rear surface of the case. Placement of a plastically deformable material of elongated shape between the bending mandrel and the force mandrel and actuation of the means for actuating results in rotation of the bending member and bending of the plastically deformable material of elongated shape.

In another embodiment, device for bending a workpiece is disclosed including a case and hydraulic supply hoses. The hydraulic supply hoses are connected to a skid-steer loader through an industry standard quick-connect interface. A rotary hydraulic actuator is mounted within and affixed to the case and has an rotating flange that rotates responsive to hydraulic pressure. A hydraulic control valve receives the hydraulic pressure from the skid-steer loader thought the hydraulic supply hoses and controls flow of the hydraulic pressure to the rotary hydraulic actuator in at least two modes. A bending member is coupled to the rotating flange such that the bending member rotates responsive to rotation of the rotating flange. A shaft is affixed at one end to a rear surface of the case and passes through the rotating flange and passes through the bending member, extending out of the bending member. A bending mandrel is removably mounted on the end of the shaft where the shaft extends out of the bending member and a force mandrel is mounted on a face of the bending member. The case has at least one quick attach flange on an outer surface of the case for attaching the case to a machine such as a boom of the skid-steer loader. The rotating flange and bending member rotate around the shaft when the hydraulic pressure is applied to the rotary hydraulic actuator.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
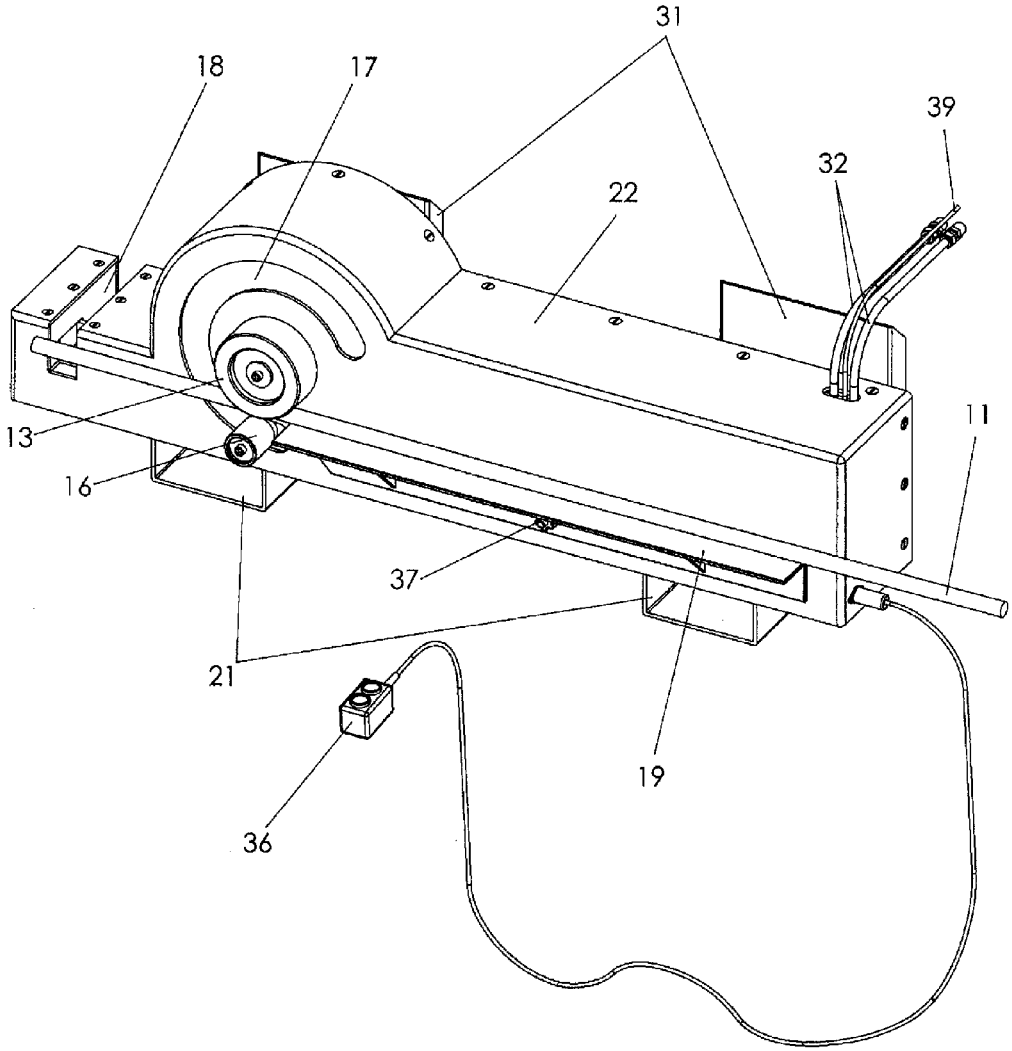
FIG. 1 is an isometric front view with the control switch attached. A piece of rebar is inserted and ready to bend.
Figure 2:
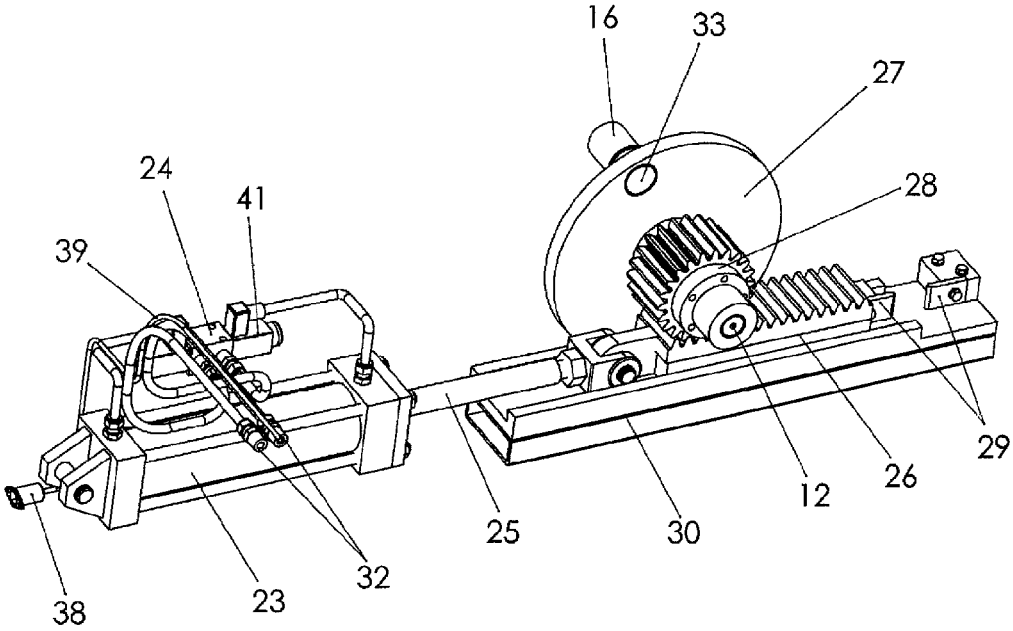
FIG. 2 is an isometric back view with the case, rear cover, work tray and quick-attach flanges removed for better viewing of the internal parts.
Figure 3:
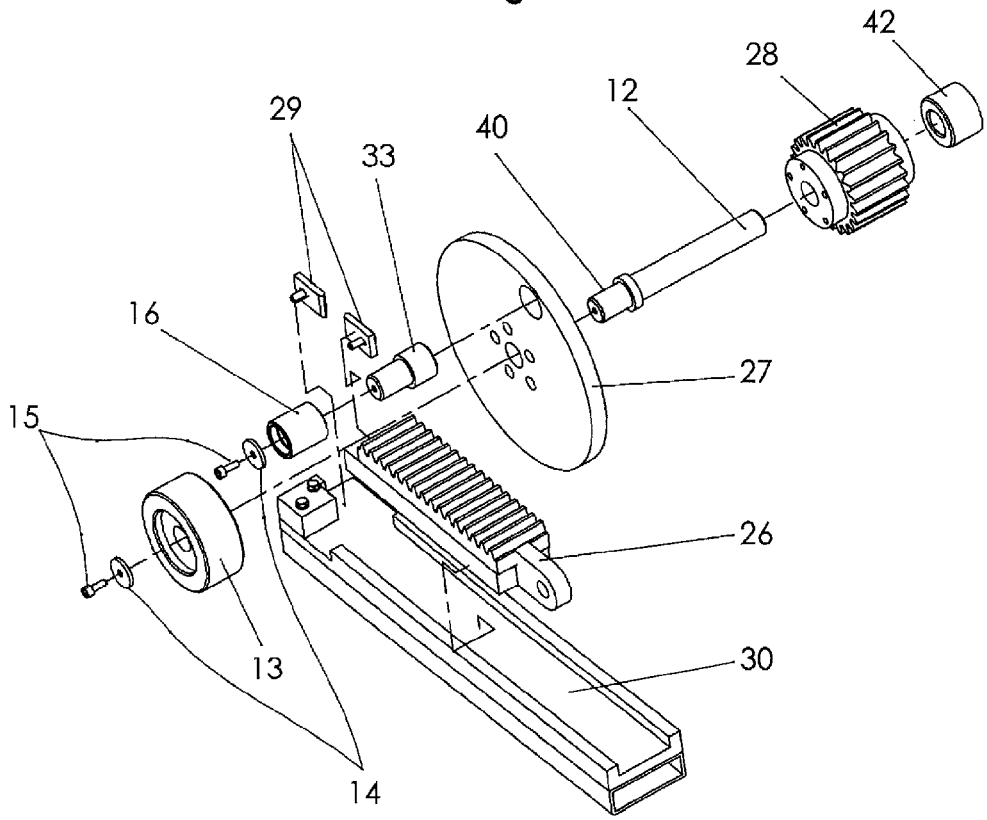
FIG. 3 is an exploded view of the internal parts. For clarity the case, rear cover, work tray, quick-attach flanges, electrical and hydraulics are not displayed.
Figure 4:
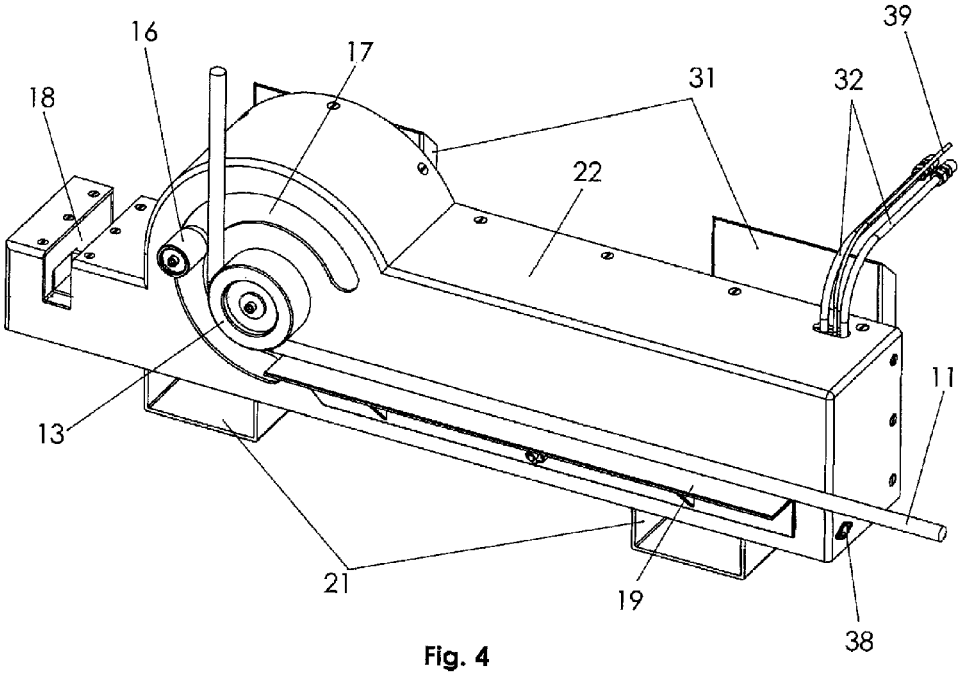
FIG. 4 shows the machine with a piece of rebar positioned on the work tray and bent 90 degrees. The control switch is unplugged and not shown.
Figure 5:
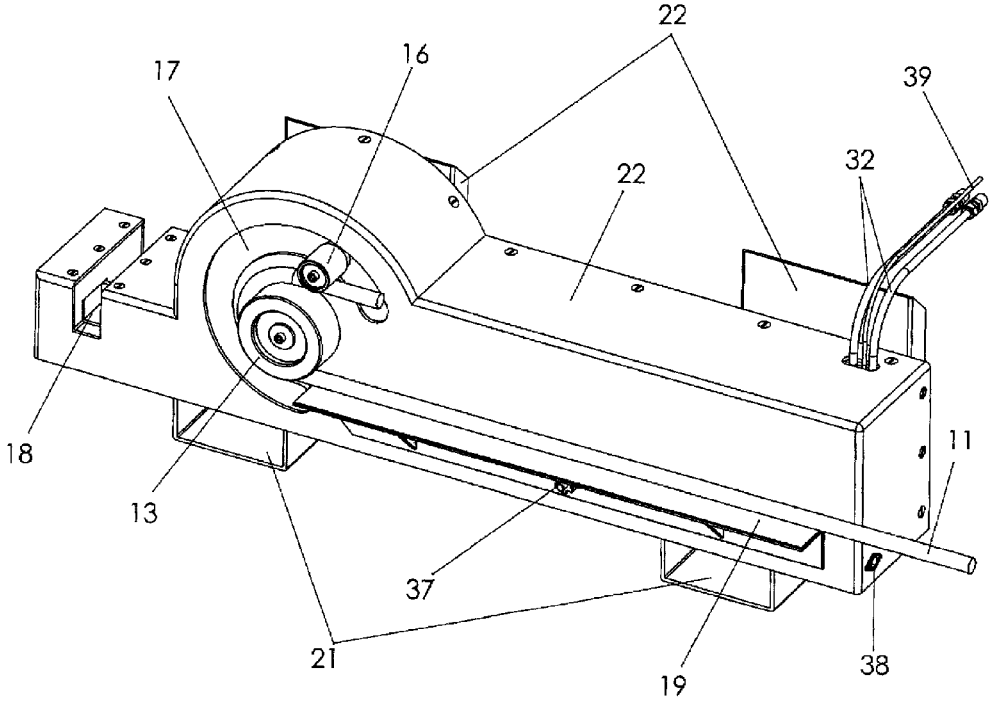
FIG. 5 shows the machine with a piece of rebar positioned on the work tray and bent 180 degrees. The control switch is unplugged and not shown.
Figure 6:
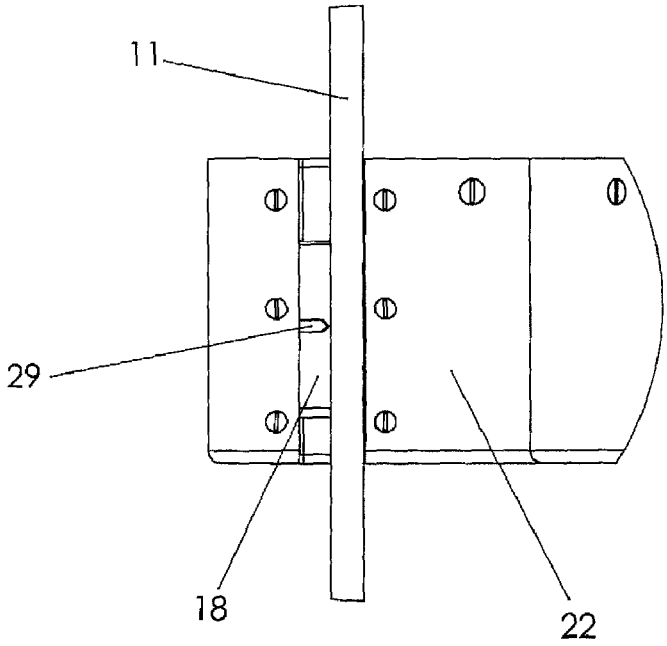
FIG. 6 shows the machine with a piece of rebar inserted in the cutting-zone and ready to be cut.
Figure 7:
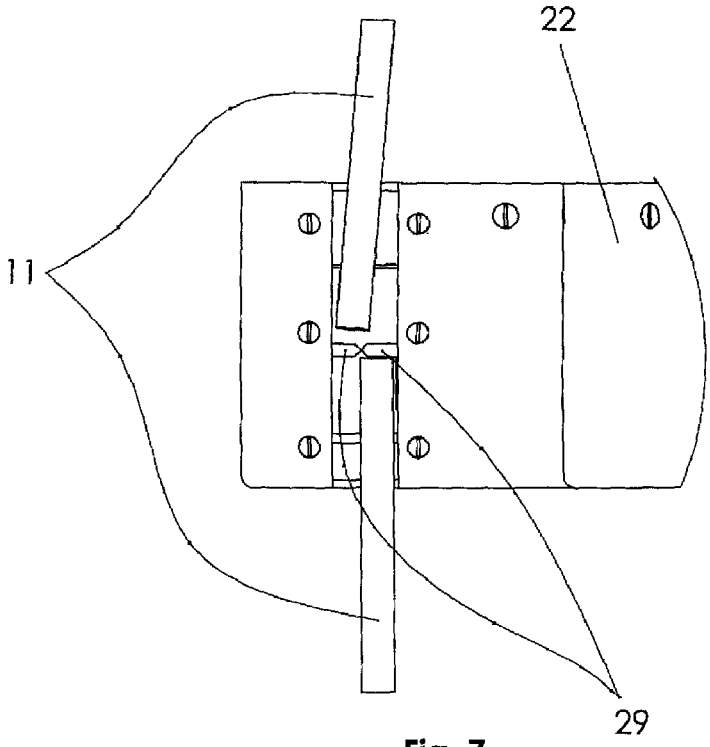
FIG. 7 shows the machine with a piece of rebar inserted in the cutting-zone and cut.
Figure 8:
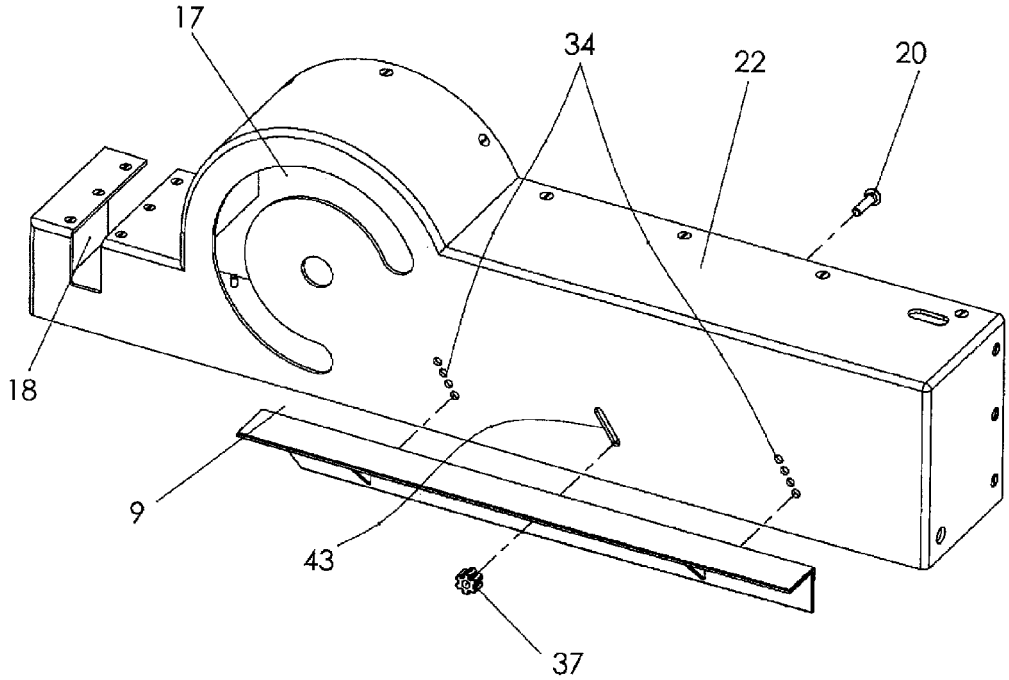
FIG. 8 shows an exploded view of the case and work tray components.
Figure 9:
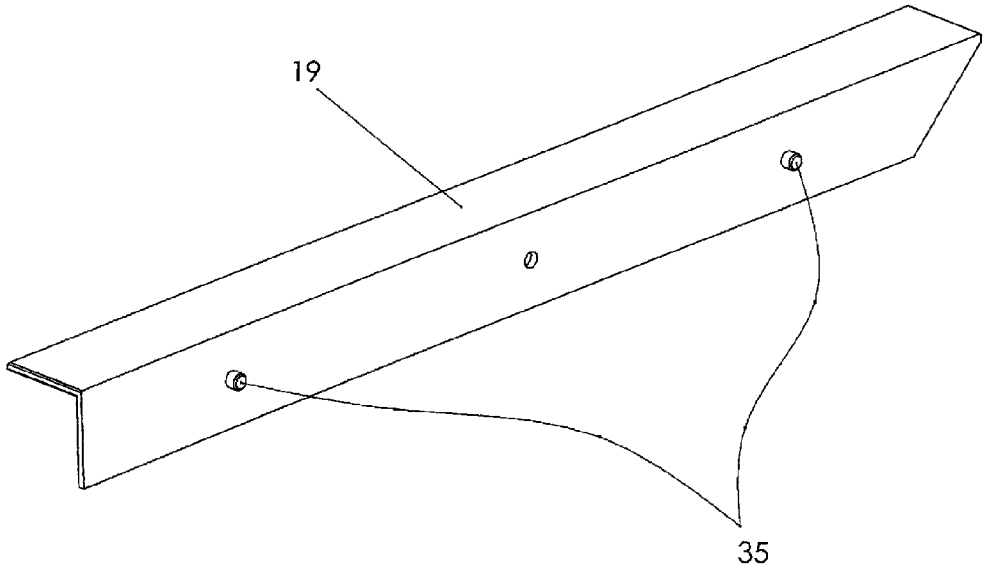
FIG. 9 shows a rear isometric view of the work tray for viewing of the adjustment pins.
Figure 10:
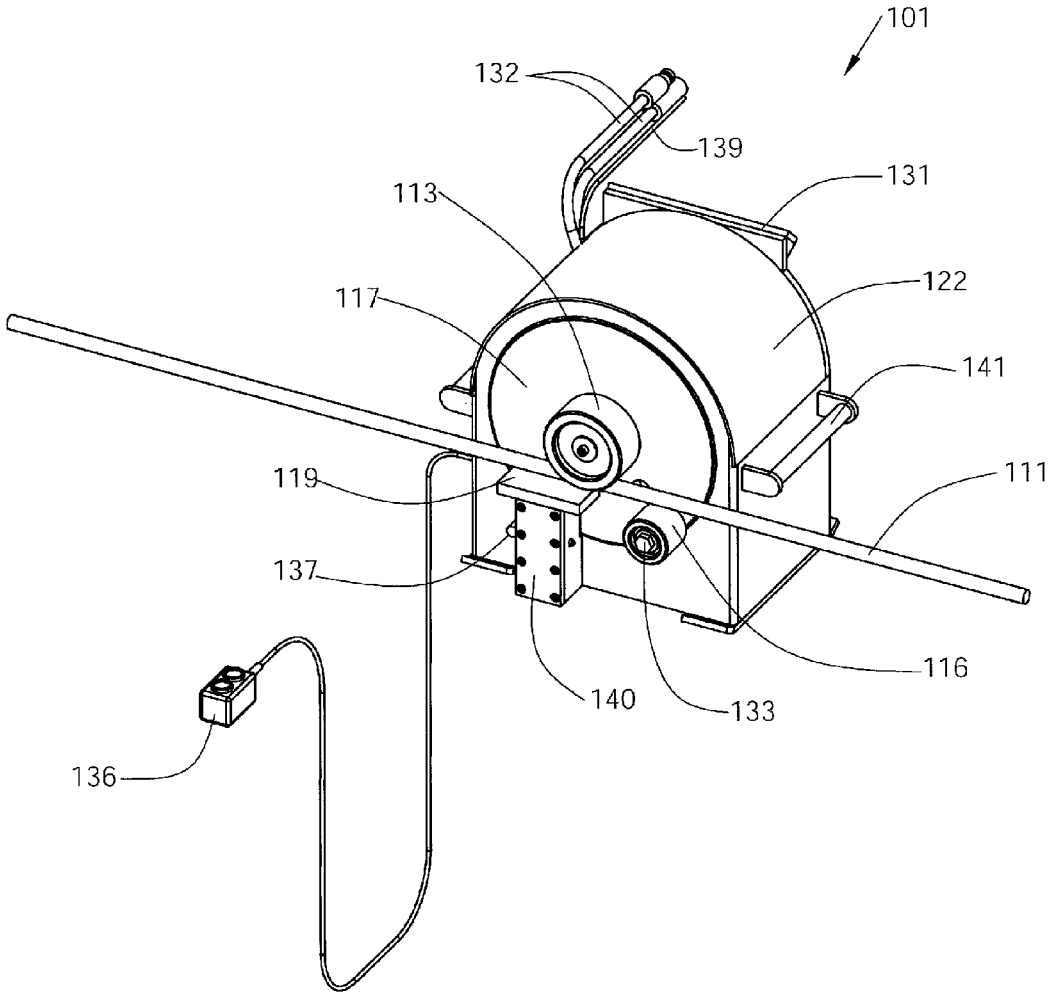
FIG. 10 is an isometric front view of an alternate embodiment with the control switch attached. A piece of rebar is inserted and ready to bend.
Figure 11:
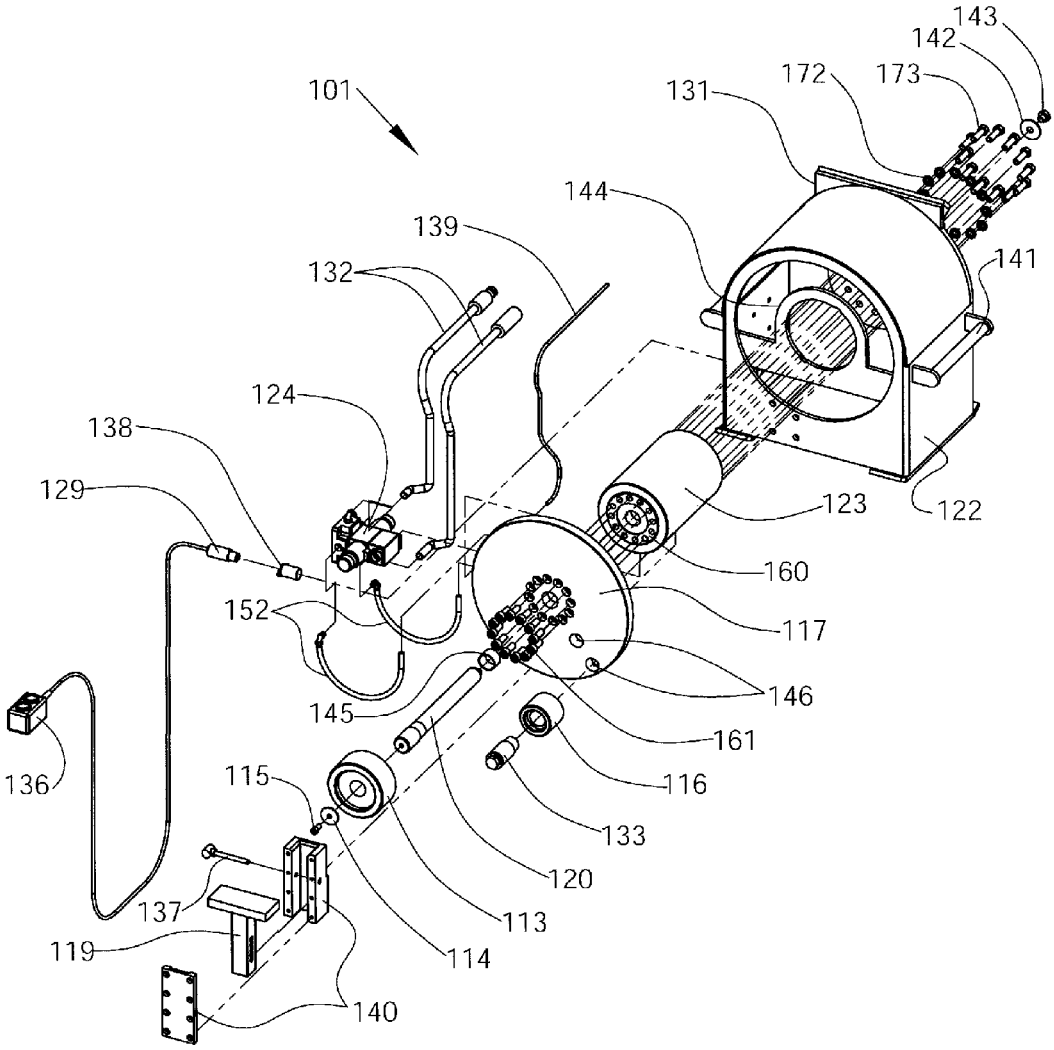
FIG. 11 is an exploded view of the alternate embodiment showing the relationship of internal parts.
Figure 12:
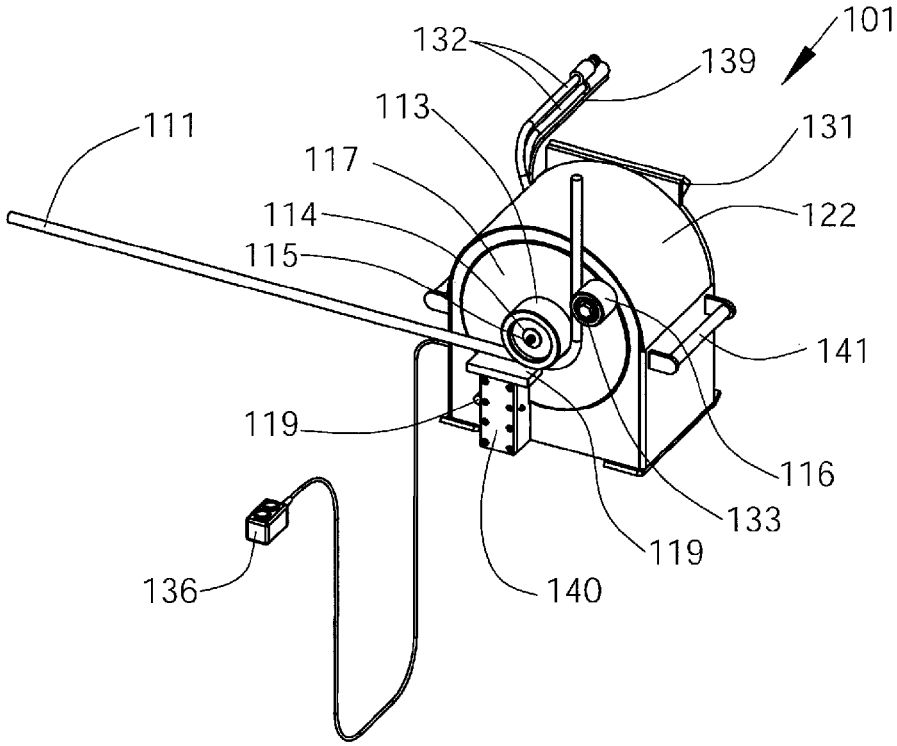
FIG. 12 shows a front perspective view of the alternate embodiment with a piece of rebar positioned on the work tray and bent 90 degrees.
Figure 13:
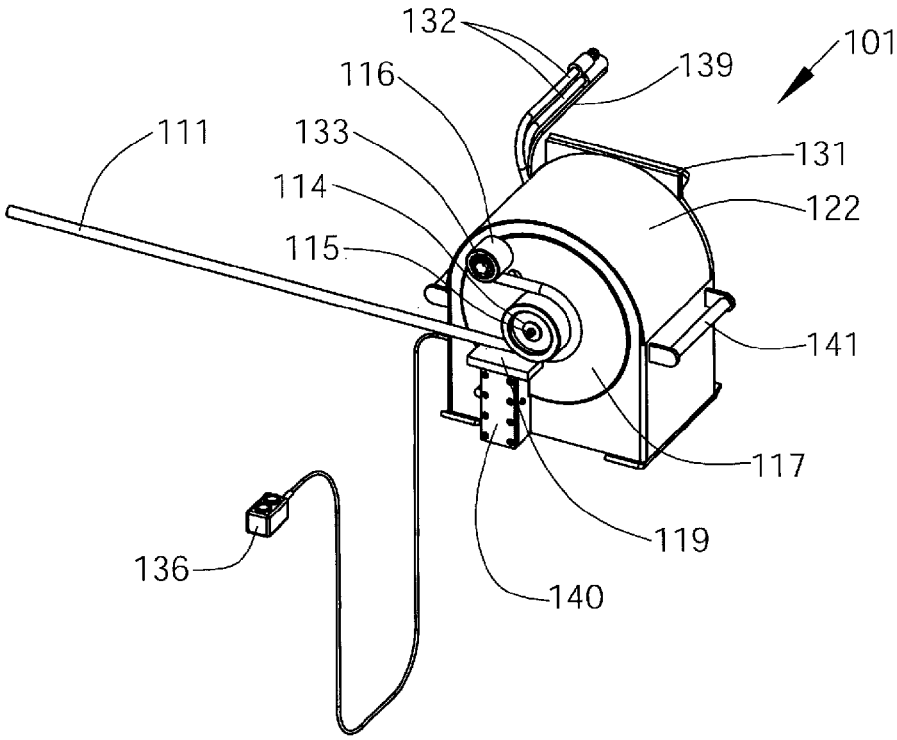
FIG. 13 shows a front perspective view of the alternate embodiment with a piece of rebar positioned on the work tray and bent 180 degrees.

Reference will now be made in detail to the presently preferred embodiments of the invention, examples of which are illustrated in the accompanying drawings. Throughout the following detailed description, the same reference numerals refer to the same elements in all figures.

The disclosed machine bends and/or cuts elongated bendable objects such as concrete reinforcement bar commonly known as "Rebar". For the purpose of these specifications the term "Rebar" will be used throughout. This is not to limit the scope to only rebar since the machines design favors bending any kind of plastically deformable material that is elongated in shape. In addition, the preferred embodiment of the machine is to be mounted and hydraulically powered by a "skid-steer" loader vehicle. For the purposes of these specifications the term "skid-steer" will be used throughout. This is not to limit the scope of the machine to skid-steer loaders since by design it is capable of being mounted and powered by any type of vehicle with a hydraulic power source of sufficient output to operate the machine, such as backhoes, tractors, articulating loaders, forklifts and the like.

In one embodiment, the bender machine is comprised of a hydraulic cylinder 23 attached to a case 22 on the cylinder end, and to a rack gear slide-bar assembly 26 on the hydraulic ram 25 end. The slide-bar rack gear assembly 26 travels laterally through a slide channel 30. The purpose of the slide channel 30 is to guide the slide-bar rack gear assembly 26 as it travels back and forth. A pinion gear 28 is free mounted on a fixed axel 12 in such a manner that it engages the slide-bar rack gear assembly 26. When the hydraulic cylinder 23 is powered the slide-bar rack gear assembly 26 moves laterally causing the pinion gear 28 to turn proportionally. A bending disc 27 is connected to the pinion gear 28 and mounted on the common fixed axel 12 so as to turn in unison with the pinion gear 28. Although shown as a bending disc 27, there is no requirement that this component be shaped as a disc. Both the pinion gear 28 and the bending disc 27 rotate freely on the fixed axel 12. The fixed axel 12 penetrates the front face of the case 22 and acts as a mounting shaft for various size mandrels. The portion of the fixed axle 12 that protrudes outside the front of the case 22 will be identified as the bend shaft 40.

The bending disc 27 has a force shaft 33 mounted toward the outside edge and perpendicular to its face. Said force shaft travels in a circular cut-out 17 in the face of the case 22. The force shaft 33 is of the same diameter as the bend shaft 40 so as to allow mandrels to be interchanged. The mandrels here forward will be called the force mandrel 16 when installed on the force shaft 33 and the bend mandrel 13 when installed on the bend shaft 40. The force mandrel 13 and the bend mandrel 16 vary in size to accommodate industry standard minimum bend radii. The fixed axel 12 is fixed in position so as not to rotate when the pinion gear 28 and the bending disc 27 rotate.

The force shaft 33 is fixed in position so as not to turn. The force shaft 33 has a shoulder to keep the force mandrel 13 from contacting the face of the case 22 when it is installed. The end of the force shaft 33 is drilled and tapped to accept a retaining bolt 15 and retaining washer 14. The retaining bolt 15 and retaining washer 14 prevent the force mandrel 16 from coming off the force shaft 33. The length of the force shaft 33 is such that when the retaining bolt 15 and the retaining washer 14 is installed and tightened the force mandrel 16 can rotate freely. This allows the force mandrel 16 to roll over the rebar 1 and around the bend mandrel 13 as the machine is working.

Mounted on the face of the case 22 is an adjustable work tray 19 used to position and support the rebar 1 while bending. The work tray 19 has two adjustment pins 35 mounted on the face that contacts the case 12. The adjustment pins 35 are positioned towards the ends of the work tray 19. The case 22 has a series of adjustment holes 34 positioned horizontally so as to line up with the work tray 19 adjustment pins 35. The adjustment holes 34 are positioned vertically at a height on the case 22 so as to allow the work tray 19 to be positioned the proper increment up or down according to the rebar 11 size. The adjustment holes 34 are also positioned vertically at an angle so as to move the work tray 19 horizontally closer to the bend mandrel 13 when smaller sizes are installed thereby keeping a uniform distance between the bend mandrel 13 and the end of the work table 19. The work table 19 is secured to the case 22 with an adjustment bolt 20 and an adjustment knob 37. The adjustment bolt 20 is allowed to travel vertically in an adjustment slot 43 cut in the case 22. The adjustment slot 43 is cut at the same angle as the adjustment holes 34. To adjust the height of the work tray 19 simply loosen the adjustment knob 37 to allow the enough space between the case 22 and the work tray 19 to disengage the adjustment pins 35 from the adjustment holes 34. Position the work tray 19 to the desired level by lining up the adjustment pins 35 with the adjustment holes 34 and tighten the adjustment knob 37.

The bend shaft 40 is drilled and tapped to accept a retaining bolt 15 and retaining washer 14. The purpose of the retaining bolt 15 and retaining washer 14 are to secure the bend mandrel 13 on the bend shaft 40. The length of the bend shaft 40 is slightly shorter than the bend mandrels 13 depth. When the bend mandrels 13 retaining bolt 15 and retaining washer 14 is installed and tightened the bend mandrel 13 will be drawn snuggly against the front of the case 22 thereby preventing it from rotating. This keeps the rebar 11 from rolling forward when bending.

The hydraulic cylinders 23 fluid and pressure is supplied by the skid-steer loader through hydraulic hoses 32 with industry standard quick-connect fittings. When the hydraulic supply hoses 32 are connected to the skid-steer, hydraulic pressure flows through the hydraulic supply hoses 32 to the hydraulic manifold 24. An electric solenoid hydraulic control valve 41 mounted in the hydraulic manifold 24 controls the flow of hydraulic fluid from the hydraulic manifold 24 to the hydraulic cylinder 23. The hydraulic control valve 41 is powered, for example, from the skid-steer loaders electric system by connecting the machines power supply cord 39 to the skid-steer loaders power receptacle mounted on the boom.

Actuation of the hydraulic control valve 41 is accomplished by an actuation device such as a foot pedal or a hand selector switch. In an alternate embodiment the hydraulics are controlled by a manual spool valve. In still other embodiments, programmable logic controllers are incorporated for automation. From here forward we will refer to the actuating device as a control switch 36.

To operate the Hydraulic Bender Cutter machine, attach the machine by maneuvering the skid-steer loader so as the loaders mounting plates engage the quick-attach flanges 31 on the back of the machines case 22. Attach the hydraulic supply hoses 32 to the skid-steers hydraulic quick-connect fittings. Raise and tilt the machine to the desired work height and angle.

Install the proper size force mandrel 16 on said force shaft and secure the force mandrel 16 by installing the retaining washer 14 and the retaining bolt 15 in the tapped hole in the force shaft 33. Install the proper size bend mandrel 13 on the bend shaft 40 and secure the bend mandrel 13 by installing the retaining washer 14 and the retaining bolt 15 in the tapped hole in the bend shaft 40.

Adjust the height of the work tray 19 by loosening the adjustment knob 37 to allow enough space between the case 22 and the work tray 19 to disengage the adjustment pins 35 from the adjustment holes 34. Position the work tray 19 to the desired level by lining up the adjustment pins 35 with the adjustment holes 34 and tighten the adjustment knob 37.

Place the rebar 11 on the work tray 19 and position the rebar 11 laterally so that the desired bend point is under the bend mandrel 13. It is anticipated that the bender will bend multiple rebar 11 sections simultaneously by stacking the bars flat on the work tray. When ready to bend, activate the control switch 36 in the bend direction. Release the control switch 36 when the bend has reached the desired angle. Return the force mandrel 16 to the start position by activating the control switch 36 in the return direction.

For cutting, with the hydraulic cylinder 23 in the retracted position, place the rebar 11 in the cutting zone 18 and activate the control switch 36 as if bending. When the cutter blades 29 meet, the rebar 11 will be cut. To open the cutter blades 29 for another cut, simply activate the control switch 36 in the return direction until the cutting zone 18 is clear.

Referring to FIGS. 10-14, in another embodiment, the bending device 101 utilizes a rotary hydraulic actuator 123 instead of the linear actuator 23. Although a rotary hydraulic actuator 123 is described throughout this specification, any type of rotary actuator or rotary motor that is powered by hydraulic pressure is anticipated, for example, a hydraulic motor, etc. This embodiment includes in a bending device 101 that performs the same or similar bending operation as the first embodiment. The bending device 101 includes a rotary hydraulic actuator 123 attached to a case 122 by, for example, screws 173 and washers 172. In a preferred embodiment, a front support 144 integral or affixed to the case 122 provides additional support to the front area of the rotary hydraulic actuator 123. In such, an opening in the front support 144 is sized to tightly fit the rotary hydraulic actuator 123 and support the rotary hydraulic actuator 123, especially during bending operation. When the rotary hydraulic actuator 123 is powered by hydraulic pressure, the rotating flange 160 rotates. A bending disc 117 is connected to the rotating flange 160 by, for example, screws 161 and the bending disc 117 turns in unison with the rotating flange 160. Although shown as a bending disc 117, there is no requirement that this component be shaped as a disc.

The bending disc 117 turns in unison with the rotating flange 160. In a preferred embodiment, a bend shaft 120 passes through the rotating flange 160 to the back surface of the case 122. In preferred embodiments, the bend shaft 120 extends from the bending disc 117, through the rotary hydraulic actuator 123 and is bolted to the back surface of the case 122 using, for example, by a washer 142 and nut 143. This provides for added strength. Although, in some embodiments the bend shaft 120 rotates with the rotating flange 160, it is preferred that the bend shaft 120 not rotate as will be discussed later. In some embodiments, the bend shaft 120 has a non-round (e.g. square, triangular, etc) end that mates with a similar shape opening in the back surface of the case 122. This further prevents the bend shaft 120 from turning. Therefore, the bending disk 117 rotates around the bend shaft 120 while the bend shaft 120 remains stationary with the assistance of an optional bearing 145 which is press-fit into the bend disc 117.

The bending disc 117 has a force shaft 133 mounted perpendicular to its face in any of one or more holes 146 spaced at differing distances from the center of the bending disc 117. In some embodiments, the force shaft 133 is of the same diameter as the bend shaft 120 so as to allow mandrels 113/116 to be interchanged. The mandrels 113/116 include a force mandrel 116 installed on the force shaft 133 and a bend mandrel 113 installed on the bend shaft 120. The force mandrel 113 and the bend mandrel 116 vary in size to accommodate industry standard bend radii. In the preferred embodiment, the bend shaft 120 is fixed in position so as not to rotate when the bending disc 117 rotates. In such, when the rebar 111 is bent by a force of the force mandrel 116 orbiting as the bending disc 117 rotates, the rebar 111 isn't pulled horizontally by rotation of the bend mandrel 113 since the bend mandrel 113 is coupled to the shaft which is fixed to the rear surface of the case 122 and, therefore, does not rotate.

In one embodiment, an end of the bend shaft 120 is drilled and tapped to accept a retaining bolt 115 and retaining washer 114. The retaining bolt 115 and retaining washer 114 hold the bend mandrel 120 on the end of the bend shaft 120. Any other attachment mechanism is anticipated; including quick connect/disconnect attachment mechanisms.

In this example, the force mandrel 116 is mounted to the bending disc 117 on a force shaft 133. The force shaft 133 is affixed or screwed into one or more holes, threaded holes or slots 146 in the bend disc 117. It is preferred that for a threaded interface, the threads are reverse-threaded to reduce issues with the force shaft 133 coming lose during bending. It is preferred that the force mandrel 116 rotates freely on the force shaft 133. This permits the force mandrel 116 to roll over the rebar 111 while the force mandrel 116 orbits the bend mandrel 113 as the machine bends the rebar 111. Alternatively, the force mandrel 116 is fixed to the force shaft 133 and the force shaft 133 is rotatably interfaced to the bend disc 117, providing a similar feature. The force mandrel 116 is held to the force shaft 133 in any way known in the industry including a tapped end on the force shaft 133 using a bolt 115 and washer 114 as with the bend shaft 120. It is also anticipated that the bend mandrel 113, as with the force mandrel 116, is mounted to the shafts 120 using quick-release devices for simplified exchange.

In a preferred embodiment, an adjustable work tray 119/137/140 is mounted on the face of the case 122 for positioning and supporting the rebar 111. The work tray 119/137/140 has an adjustment pin 137 that pass through an outer bracket 140 and holds a work surface 119 in a proper position such that the rebar 111, is held parallel to the top surface of the work surface 119 properly contacts the bend mandrel 113. The work tray 119/137/140 has a series of adjustment holes positioned horizontally so as to adjust the work surface 119 properly for a variety of different sized bend mandrels 113. Lack of rotation of the bend mandrel 113 prevents the rebar 111 from moving horizontally while bending is performed. There are many known ways to provide an adjustable work surface 119, all of which are anticipated and included here within.

Fluid pressure is supplied by the skid-steer loader through hydraulic hoses 132 with industry standard quick-connect fittings. When the hydraulic supply hoses 132 are connected to the skid-steer, hydraulic pressure flows through the hydraulic supply hoses 132 to the hydraulic manifold/valve 124. The hydraulic manifold/valve 124 controls the flow of hydraulic fluid from the hydraulic manifold/valve 124 to the rotary hydraulic actuator 123 through hydraulic tubes 152. In embodiments where the hydraulic manifold/valve 124 is powered by electric current, a power connection 139 is provided. For example, the power cord 139 connects to the skid-steer loaders electric system through the skid-steer loaders power receptacle. In some embodiments, power is provided to the hydraulic manifold/valve 124 by a battery system (not shown). In some embodiments, the hydraulic manifold/valve 124 is a manually operated valve, requiring no electric power.

Actuation of the hydraulic manifold/valve 124 is accomplished by an actuation device such as a foot pedal or a hand control switch 136. In come embodiments, the switch 136 has a plug end 129 that mates with a jack 130 on the hydraulic manifold/valve 124. In an alternate embodiment, programmable logic controllers or the like are incorporated for automation.

The hydraulic manifold/valve 124 has three operating modes. In a first operating mode, hydraulic fluid flows freely from the skid-steer loader output port, through the hydraulic manifold/valve 124 and back to the skid-steer loader input port so as to not load the hydraulic pump system within the skid-steer loader. In a second operating mode, the hydraulic manifold/valve 124 routes the hydraulic fluid (under pressure) through the hydraulic tubes 152 and through the rotary actuator 123 in a first direction, causing the rotary actuator 123 to turn in a first direction. In a third operating mode, the hydraulic manifold/valve 124 routes the hydraulic fluid (under pressure) through the hydraulic tubes 152 and through the rotary actuator 123 in a second direction, causing the rotary actuator 123 to turn in a an opposite direction.

In some embodiments, handles 141 are provided for manual lifting of the bender machine 101.

Figure 14:
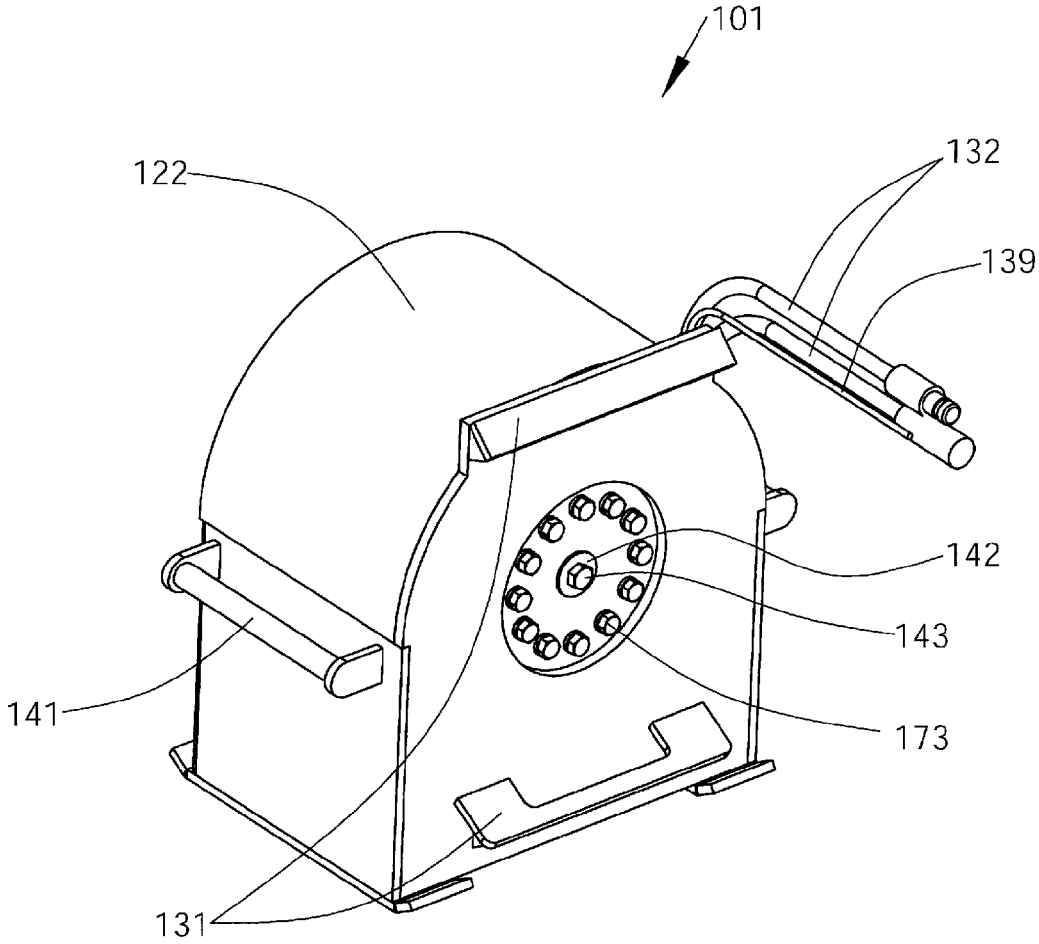
FIG. 14 shows a rear perspective view of the alternate embodiment.

To operate the bender machine 101, attach the bender to a skid-steer loader by maneuvering the skid-steer loader so as the loaders mounting plates engage the quick-attach flanges 131 on the back of the machines case 122 as shown in FIG. 14. Quick-attach flanges 131 are well known in the industry and often include a top and bottom engagement mechanism 131 as shown in FIG. 14.

The hydraulic supply hoses 132 are attached to the skid-steers hydraulic quick-connect fittings. Raise and tilt the bender to the desired work height and angle.

Install the proper size force mandrel 116 on the force shaft 133 by inserting the shaft 133 into the force mandrel 116 and screwing shaft 133 into one of the threaded holes 146. Install the proper size bend mandrel 113 on the bend shaft 120 and secure the bend mandrel 113 by installing the retaining washer 114 and the retaining bolt 115 in the tapped hole in the bend shaft 120.

Adjust the height of the work tray 119 to the desired level by lining up the adjustment holes and insert the adjustment pin 137.

Place the rebar 111 on the work tray 119 and position the rebar 111 laterally so that the desired bend point is under the bend mandrel 113. It is anticipated that the bender will bend multiple rebar 111 sections simultaneously by stacking the bars flat on the work tray. When ready to bend, activate the control switch 136 in the bend direction. Release the control switch 136 when the bend has reached the desired angle. Return the force mandrel 116 to the start position by activating the control switch 136 in the return direction.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for bending a workpiece, the device comprising:

a rotary hydraulic actuator, the rotary hydraulic actuator fluidly coupled to a controlled source of hydraulic fluid pressure, the rotary hydraulic actuator turning an rotating flange responsive to the hydraulic fluid pressure;

a bending member coupled to the rotating flange of the rotary hydraulic actuator, the bending member rotating responsive to rotational motion of the rotating flange;

a bending mandrel mounted on a face of the bending member;

a force mandrel mounted on the face of the bending member, the force mandrel mounted in a position on the face of the bending member such that rotation of the bending member results in the force mandrel orbiting the bending mandrel;

a means for actuating the hydraulic fluid pressure;

a means for removably attaching the device for bending to a boom of a construction vehicle.

2. The device for preparing of claim 1, wherein the rotary hydraulic actuator is mounted within a case and an outside surface of the case has the means for attaching the device for bending to the boom of the construction vehicle.

3. The device for preparing of claim 2, wherein the means for removably attaching the device for bending to the boom of the construction vehicle comprises one or more industry standard quick attach flanges.

4. The device for preparing of claim 1, wherein the means for actuating the hydraulic fluid pressure provides fluid pressure to the rotary hydraulic actuator in a first direction thereby rotating the bending member in a first rotational direction and provides the fluid pressure to the rotary hydraulic actuator in an opposite direction thereby rotating the bending member in an opposite rotational direction.

5. The device for preparing of claim 1, whereas placement of a bendable object between the bending mandrel and the force mandrel and actuating the hydraulic fluid pressure to provide the fluid pressure to the rotary hydraulic actuator in the first direction results in the force mandrel orbiting around the bending mandrel, thereby bending the bendable object.

6. The device for preparing of claim 1, wherein the bendable object is rebar.

7. The device for preparing of claim 2, wherein the bending mandrel is removably attached to a bend shaft and the bend shaft passes through the bending member and through the rotating flange and is affixed to a rear surface of the case such that the bend shaft, and therefore the bending mandrel, remain rotationally stationary even when the bending member rotates.

8. A device for bending a workpiece, the device comprising:

a case;

a means for converting hydraulic pressure into a rotational force of a bending member, the rotational force controlled by a means for actuating, the means for converting hydraulic pressure into the rotational force mounted within the case;

a bending mandrel mounted on a bend shaft, the bend shaft passing through the bending member at center of rotation of the bending member and passing through the means for converting hydraulic pressure into the rotational force, the bend shaft is affixed to a back surface of the case;

a force mandrel mounted on a face of the bending member; and a means for removably attaching the device for bending the workpiece to a boom of a construction vehicle;

whereas placement of a plastically deformable material of elongated shape between the bending mandrel and the force mandrel and actuation of the means for actuating results in rotation of the bending member and bending of the plastically deformable material of elongated shape.

9. The device for bending of claim 8, wherein the means for removably attaching the device for preparing the workpiece to the boom of the construction vehicle comprises one or more industry standard quick attach flanges.

10. The device for bending of claim 8, wherein the means for actuating the hydraulic fluid pressure provides fluid pressure to the means for converting hydraulic pressure into the rotational force in a first direction thereby rotating the bending member in a first rotational direction and the means for actuating the hydraulic fluid pressure provides the fluid pressure to the means for converting the hydraulic pressure into the rotational force in an opposite direction thereby rotating the bending member in an opposite rotational direction.

11. The device for preparing of claim 10, whereas placement of the plastically deformable material of elongated shape between the bending mandrel and the force mandrel and actuating the means for actuating to provide the fluid pressure to the means for converting the hydraulic pressure into the rotational force in the first direction results in the force mandrel orbiting around the bending mandrel, thereby bending the plastically deformable material of elongated shape.

12. The device for preparing of claim 8, wherein the plastically deformable material of elongated shape is rebar.

13. The device for preparing of claim 8, wherein the means for converting hydraulic pressure into the rotational force of a bending member is a rotary hydraulic actuator.

14. A device for bending a workpiece, the device comprising:

a case;

hydraulic supply hoses, the hydraulic supply hoses for connecting to a hydraulic system of a skid-steer loader through an industry standard quick-connect interface;

a rotary hydraulic actuator mounted within and affixed to the case, the rotary hydraulic actuator having an rotating flange that rotates responsive to hydraulic pressure from the hydraulic supply hoses;

a hydraulic control valve, the hydraulic control valve receiving the hydraulic pressure from the hydraulic supply hoses, the hydraulic control valve controllable in at least two modes;

a bending member coupled to the rotating flange, the bending member rotating responsive to rotation of the rotating flange;

a bend shaft affixed at one end to a rear surface of the case, the bend shaft passing through the rotating flange and passing through the bending member and extending out of the bending member;

a bending mandrel removably mounted on the end of the bend shaft that extends out of the bending member; and a force mandrel mounted on a face of the bending member;

whereas the case has at least one quick attach flange on an outer surface of the case, the quick attach flange for attaching the case to a boom of the skid-steer loader and whereas the rotating flange and bending member rotate around the bend shaft when the hydraulic pressure is applied to the rotary hydraulic actuator.

15. The device for preparing of claim 14, wherein the hydraulic control valve provides the hydraulic pressure to the rotary hydraulic actuator in a first direction thereby rotating the bending member in a first rotational direction and the hydraulic control valve provides the hydraulic pressure to the rotary hydraulic actuator in an opposite direction thereby rotating the bending member in an opposite rotational direction.

16. The device for preparing of claim 14, wherein the bending member is a bending disc.

17. The device for preparing of claim 14, wherein the plastically deformable material of elongated shape is rebar.

18. The device for preparing of claim 14, wherein the bending mandrel is removably attached to the bend shaft and the force mandrel is removably attached to the bending member.

19. The device for preparing of claim 14, wherein the one end of the bend shaft has a non-round cross section and the rear surface of the case has a similar shaped hole for accepting the non-cross section at the one end, thereby preventing the bend shaft from rotating.

20. The device for preparing of claim 14, wherein the one end of the bend shaft has a non-round cross section and is drilled and tapped and the rear surface of the case has a similar shaped hole for accepting the non-cross section at the one end of the bend shaft and a bolt and washer hold the bend shaft in the similar shaped hole, thereby preventing the bend shaft from rotating.

* * * * *